US005647730A

United States Patent [19]

Woollatt

[11] Patent Number: 5,647,730

[45] Date of Patent: Jul. 15, 1997

[54] SELF-CONTAINED, CLEARANCE-VOLUME ADJUSTMENT MEANS FOR A GAS COMPRESSOR

[75] Inventor: Derek Woollatt, Campbell, N.Y.

[73] Assignee: Dresser-Rand Company, Corning, N.Y.

[21] Appl. No.: 631,647

[22] Filed: Apr. 8, 1996

[51] Int. Cl.[6] ..... F04B 49/16

[52] U.S. Cl. ..... 417/274; 92/605

[58] Field of Search ..... 417/274, 455, 417/506, 509, 212; 92/13.6, 13.1, 60.5

[56] References Cited

U.S. PATENT DOCUMENTS

| | | | |
|---|---|---|---|
| 1,621,913 | 3/1927 | Longacre | 417/274 |
| 1,639,439 | 7/1927 | Riesner | 92/60.5 |
| 1,985,642 | 12/1934 | Moody | 417/569 |
| 3,198,421 | 8/1965 | Alyea et al. | 92/60.5 |
| 4,775,299 | 10/1988 | Overfield et al. | 417/274 |
| 5,049,040 | 9/1991 | Diab et al. | 417/274 |

*Primary Examiner*—Timothy Thorpe
*Assistant Examiner*—Roland G. McAndrews
*Attorney, Agent, or Firm*—Bernard J. Murphy

[57] ABSTRACT

In association with a straight-cylinder, reciprocating gas compressor, hydraulic circuitry and valving is provided to track movement of an intake valve which cooperates with an end of the compressor to define a clearance volume. The valving is selectively operative to cause the intake valve to reposition in more proximity to the end of the compressor, or more in proximity to its confronting discharge valve.

13 Claims, 2 Drawing Sheets

SELF-CONTAINED, CLEARANCE-VOLUME ADJUSTMENT MEANS FOR A GAS COMPRESSOR

This invention pertains to clearance-volume adjustment arrangements employed to vary the capacity of reciprocating gas compressors, and in particular to a clearance-volume adjustment means for a gas compressor which is self-contained.

A common way of adjusting the capacity of a reciprocating gas compressor is to vary the clearance volume. The methods most commonly used vary the clearance in fixed steps, and can be operated remotely or automatically. There are advantages in being able to vary the clearance volume continuously, to provide precise matching of the compressor capacity to the operating requirements. Such are often called infinite step capacity controls. The infinite step capacity control is usually accomplished either by moving a piston in a chamber which is connected to the working compressor cylinder, or by a device that interferes with the valve motion. The former usually cannot be operated remotely or automatically; the latter has a limited range of adjustment, and can adversely affect valve reliability.

The piston in an infinite step unloading device can be operated remotely or automatically fitting it with an actuator of some kind, for example, a hydraulic cylinder, an electric or pneumatic motor. These have the disadvantage that an external power source is required. In many circumstances, as when the compressed gas is flammable, electric power cannot be used for safety reasons.

What has been needed is an infinite step, clearance-volume adjustment means for a reciprocating gas compressor which is self-contained, that is, such means which requires no external power source. Accordingly, it is an object of this invention to set forth just such a needed self-contained, clearance-volume adjustment means for a gas compressor. Particularly, it is an object of the invention to disclose a self-contained, clearance-volume adjustment means, for a gas compressor which has (a) a gas intake port, and (b) a head-end piston displaceable in adjacency to said port, comprising a source of hydraulic fluid; a cylinder; means for communicating said source with said cylinder for admitting fluid into, and for prohibiting fluid evacuation from, said cylinder; wall means, confined within said cylinder, and movable therewithin, for subdividing said cylinder into a pair of chambers; a rod connecting said wall means to said piston for effecting movement of said wall means in common with said piston; and valving means, cooperative with said communicating means, and coupled to said cylinder, operative in a (a) first mode for evacuating fluid from said cylinder, in response to a displacement of said piston in a first direction, and (b) second mode for admitting fluid into said cylinder, in response to a displacement of said piston in a second direction.

Figure 1:
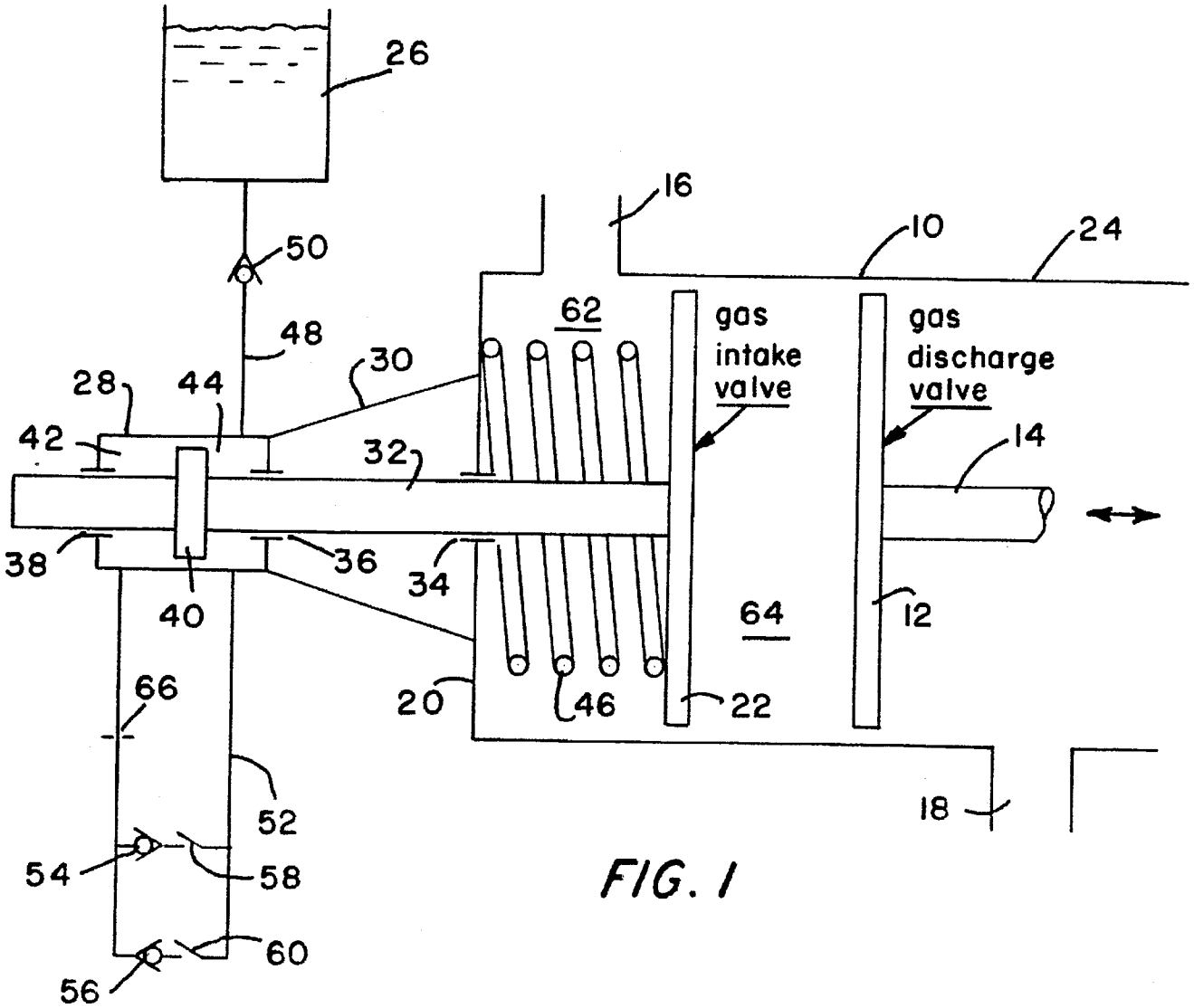
Figure 2:
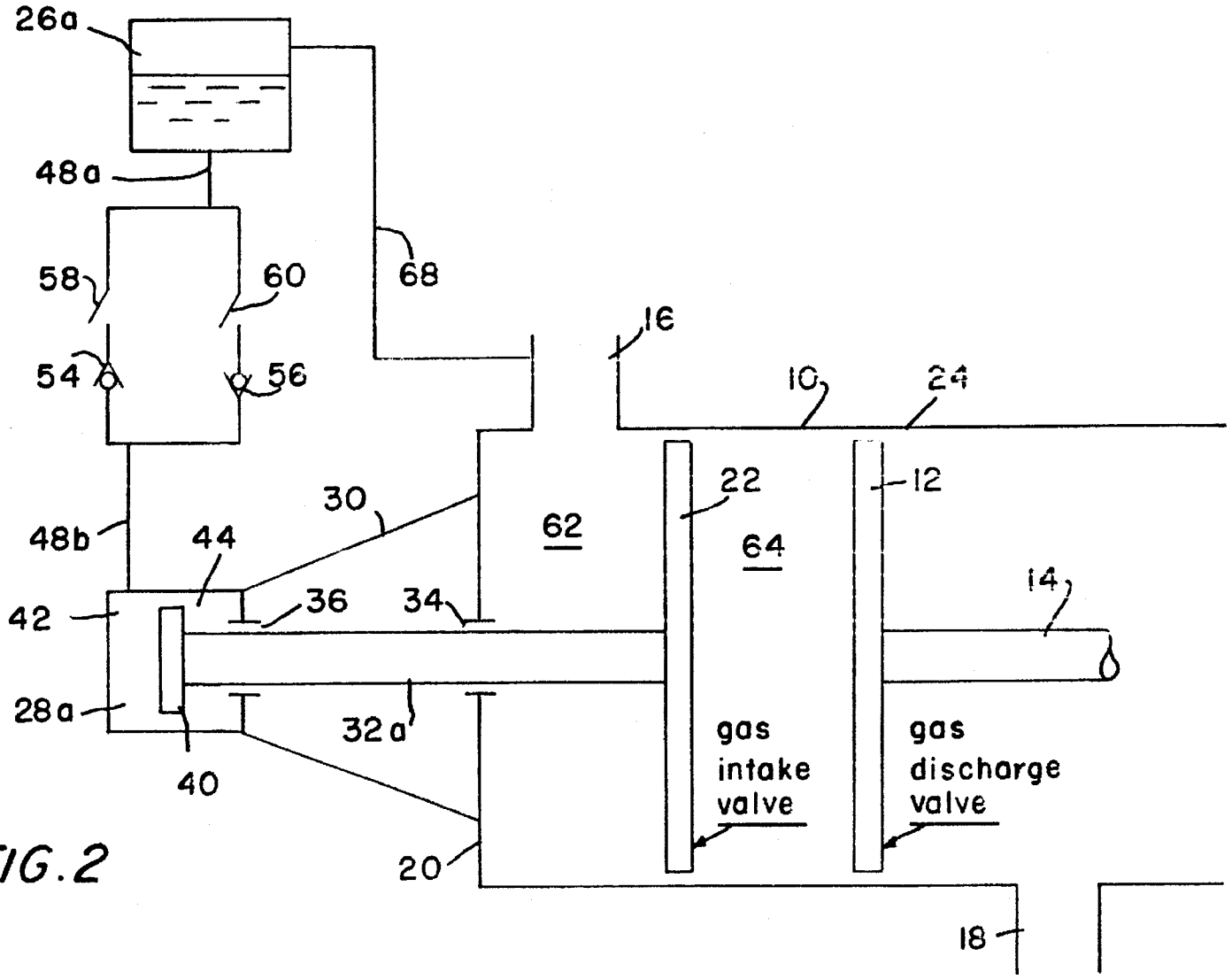

Further objects of this invention, as well as the novel features thereof, will become apparent by reference to the following description, taken in conjunction with the accompanying figures, in which:

FIG. 1 is a schematic diagram of an embodiment of the means, according to the invention; and FIG. 2 is a schematic diagram of an alternate embodiment of the invention.

The invention is joined to a gas compressor having a straight cylinder in which at least one reciprocable discharge valve, which serves also as a gas compressing piston, and at least one head-end intake valve are confined within the cylinder. In U.S. Pat. No. 5,011,383, issued on 30 Apr. 1991, to Robert A. Bennitt, for a "Valve Assembly, For Use In Combination With A Straight-Cylinder, Gas-Compression Chamber, And In Combination Therewith", discloses just such a gas compressor. In the cited patent, a pair of discharge valves reciprocate within the cylinder, and at opposite headed ends of the cylinder, intake valves are installed. For a frame of reference, then, toward a background understanding of the general configuration of the compressor in the instant invention, U.S. Pat. No. 5,011,383 is incorporated herein.

As shown in FIG. 1, a straight-cylinder compressor 10, only a portion of which is illustrated, confines therewithin a reciprocable, discharge valve 12, the same being coupled to a reciprocating piston rod 14. The compressor 10 has a gas intake port 16, and a gas discharge port 18, the intake port 16 being adjacent to a head end 20 of the compressor. A gas intake valve 22 is positioned adjacent to the head end 20 as well. In the cited U.S. Pat. No. 5,011,383, the corresponding head end intake valve is secured in place by means of a stub shaft. In this invention, however, the intake valve 22 is displaceable within the cylinder 24 of the compressor 10.

A source of hydraulic fluid is provided by a reservoir 26; reservoir 26 is open to the ambient pressure. A cylinder 28 is coupled to the head end 20 of the compressor cylinder 24 by means of a cowling 30. A rod 32, which is coupled to valve 22, projects through the cowling 30 and in penetration of the cylinder 28. A seal 34, in the head end 20 of the cylinder 24, and seals 36 and 38, at opposite ends of the cylinder 28, close upon the rod 32 to prohibit leakage of hydraulic fluid and/or product gas. Fixed to the rod 32, intermediate the length of the cylinder 28, is a wall 40, the same subdividing the cylinder into chambers 42 and 44; wall 40 moves in common with valve 22. A compression spring 46 is interposed between valve 22 and the head end 20 to urge the valve 22 away from the head end 20 and toward the discharge valve 12.

A conduit 48 interconnects the reservoir 26 with the cylinder 28 via chamber 44, and the conduit 48 has a check valve 50 interposed therein to prohibit fluid flow from chamber 44 to the reservoir 26. Another conduit 52 interconnects the chambers 42 and 44, and has a pair of check valves 54 and 56, as well as paired, interruptable fluid valves 58 and 60, interposed therein in parallel. Check valve 56 is disposed for cooperation with valve 60, to permit fluid flow from chamber 42 to chamber 44, whereas check valve 54 is cooperative with valve 58 to permit fluid flow from chamber 44 to chamber 42.

The volume obtaining between valve 22 and the head end 20 can be considered a vacuum chamber 62, and the volume obtaining between valves 12 and 22 can be considered a pressure chamber 64. The pressure in chamber 62 is always the suction pressure, Ps, and the pressure in chamber 64 fluctuates between the suction pressure, Ps, and the discharge pressure, Pd. Accordingly, the force on the suction or intake valve 22 varies. Spring 46 comprehends a spring biasing which exerts a force which is greater than the minimum gas pressure force on the valve 22, and less than the maximum gas pressure force on the valve 22. Consequently, the valve 22 moves toward the valve 12 during part of the cycle, and away from the valve 12 during the remainder of the cycle. In the circumstances, then, the positioning of valve 22 can be controlled by the invention without any external power.

If both valves 58 and 60 are open, i.e., interrupted, and disconnected from check valves 54 and 56, clearly, no fluid flow will occur through the conduit 52. Hence, valve 22 will remain stationary (except for any movement occasioned by the compression of the hydraulic fluid). If valve 60 is closed, i.e., not interrupted, and connected to check valve 56, then fluid flow will occur in conduit 52; fluid will flow from chamber 42 to chamber 44. However, valve 58 must be open, i.e., interrupted, for this to occur. When the gas pressure on the intake or suction valve 22 is high, it will overcome the biasing of the spring 46, and the valve 22 will migrate away from valve 12, while the hydraulic fluid is flowing from chamber 42 to chamber 44. When the pressure in chamber 64 is low, the biasing force on the valve 22 tends to move it toward the discharge valve 12. However, in that check valve 56 will not permit fluid flow from chamber 44 to chamber 42, the valve 22 does not move. All the while that valve 60 is closed, i.e., in connection with check valve 56, and valve 58 is not connected to check valve 54, the intake or suction valve 22 will move away from the discharge valve 12, incrementally, as the gas pressure in chamber 64 changes. Once the required positioning of the valve 22 is achieved, the valve 60 is opened, i.e., it is disconnected from the check valve 56, to keep the valve 22 in the new positioning. Self-evidently, valve 58, in cooperation with its associated check valve 54, can be used, as was valve 60, to move the intake or suction valve 22 to a repositioning more proximate to the discharge valve 12. Therefore, by alternative opening and closing of the valves 58 and 60, the positioning of the valve 22, relative to the end wall 20 and the discharge valve 12, can be controlled, varying the clearance volume of chamber 62, and varying the load on the compressor 10. The rate at which the repositioning of the valve 22 can be effected is reduced by a restrictor, that is, an orifice 66 interposed in conduit 52.

FIG. 2 illustrates an alternative embodiment of the invention, which is somewhat simpler in construction and, accordingly, is a preferred version; in this embodiment the compression spring 46 of FIG. 1 is not needed. The components and structures in FIG. 2 which correspond to those in FIG. 1 carry the same index numbers, and those which are similar carry similar index numbers.

In the FIG. 2 embodiment of the invention, the rod 32*a* does not fully penetrate the cylinder 28*a*, and the valves 54, 56, 58 and 60 are connected to conduit sections 48*a* and 48*b* which communicate the aforesaid valves with the hydraulic fluid reservoir 26*a* and the cylinder 28*a*. The reservoir 26*a* is closed to the ambient and, instead, has a line 68 connecting it to the intake port 16; thus, the intake pressure is impressed on the hydraulic fluid in the reservoir 26*a*.

With valve 60 closed, i.e., in fluid flow communication with valve 56, and with the discharge pressure, Pd, in chamber 64 being greater than the suction or vacuum pressure, Ps, in cylinder 28*a* and the reservoir 26*a*, there occurs a sufficient force to drive the intake or suction valve 22 away from the discharge valve 12, providing that valve 58 is not closed (i.e., not in communication with check valve 54). With both valves 58 and 60 open, to prohibit fluid flow via conduit sections 48*a* and 48*b*, the positioning of valve 22 can not be altered. Again, the alternative functioning, for movement of the valve 22 toward the discharge valve 12, can be effected by putting valve 58 in communication with its associated check valve 54, and interrupting the communication of valve 60 with its associated check valve 56. Thus, the compressor 10 can be unloaded or loaded, by altering the clearance volume thereof, by the adjustment means of FIG. 2 with no less facility than by the means of FIG. 1.

While I have described my invention in connection with specific embodiments thereof, it is to be clearly understood that this is done only byway of example, and not as a limitation to the scope of the invention, as set forth in the objects thereof, and in the appended claims.

I claim:

1. A self-contained, clearance-volume adjustment means, for a gas compressor which has (a) a gas intake port, and (b) a head-end piston displaceable in adjacency to said port, comprising:

a source of hydraulic fluid;

a cylinder;

means for communicating said source with said cylinder for admitting fluid into, and for prohibiting fluid evacuation from, said cylinder;

wall means, confined within said cylinder, and movable therewithin, for subdividing said cylinder into a pair of chambers;

a rod connecting said wall means to said piston for effecting movement of said wall means in common with said piston; and valving means, cooperative with said communicating means, and coupled to said cylinder, operative in a (a) first mode for evacuating fluid from said cylinder, in response to a displacement of said piston in a first direction, and (b) second mode for admitting fluid into said cylinder, in response to a displacement of said piston in a second direction; wherein said gas intake port is interposed between said head-end piston and said cylinder.

2. A self-contained, clearance-volume adjustment means, according to claim 1, wherein:

said valving means further comprises means operative in a third mode for prohibiting fluid evacuation From, and fluid admittance into, said cylinder.

3. A self-contained, clearance-volume adjustment means, for a gas compressor which has (a) a gas intake port, and (b) a head-end piston displaceable in adjacency to said port, comprising:

a source of hydraulic fluid;

a cylinder;

means for communicating said source with said cylinder for admitting fluid into, and for prohibiting fluid evacuation from, said cylinder:

wall means confined within said cylinder, and movable therewithin, for subdividing said cylinder into a pair of chambers;

rod connecting said wall means to said piston for effecting movement of said wall means in common with said piston; and valving means, cooperative with said communicating means, and coupled to said cylinder, operative in a (a) first mode for evacuating fluid from said cylinder, in response to a displacement of said piston in a first direction, and (b) second mode for admitting fluid into said cylinder, in response to a displacement of said piston in a second direction; and further including means for connecting said source with said intake port, for impressing intake port gas pressure on said source.

4. A self-contained, clearance-volume adjustment means, according to claim 1, wherein:

said communicating means comprises conduitry opening at opposite ends thereof onto one of said chambers and onto said source.

5. A self-contained, clearance-volume adjustment means, according to claim 4, wherein:

said valving means (a) is interposed in said conduitry, and (b) comprises a pair of check valves in parallel, and a pair of interruptible fluid valves in parallel.

6. A self-contained, clearance-volume adjustment means, according to claim 1, wherein:

said valving means further comprises means operative in a (a) first mode for evacuating fluid from said cylinder, as aforesaid, via one of said chambers, and admitting evacuated fluid into the other of said chambers, in response to displacement of said piston in said first direction, and (b) second mode for admitting fluid into said chamber, as aforesaid, via said one chamber, and evacuating fluid from the other of said chambers, in response to displacement of said piston in said second direction.

7. A self-contained, clearance-volume adjustment means, according to claim 6, wherein:

said valving means further comprises means operative in a third mode for prohibiting fluid flow between said chambers.

8. A self-contained, clearance-volume adjustment means, according to claim 1, wherein:

said communicating means comprises a first conduit opening at opposite ends thereof onto one of said chambers, and onto said source, and a second conduit opening at one end thereof onto said one chamber, and at the opposite end thereof onto the other of said chambers.

9. A self-contained, clearance-volume adjustment means, according to claim 8, wherein:

said valving means (a) is interposed in said second conduit, and (b) comprises a pair of paralleled check valves and a pair of interruptible fluid valves in parallel.

10. A self-contained, clearance-volume adjustment means, according to claim 1, further including:

means for exposing hydraulic fluid of said source thereof to a given gas pressure.

11. A self-contained, clearance-volume adjustment means, according to claim 1, wherein:

said communicating means comprises a conduit which opens at one end thereof onto said source of fluid, and opens at the opposite end onto said cylinder; and further including a check valve interposed in said conduit, intermediate the length thereof, for prohibiting fluid flow from said cylinder to said fluid source.

12. A self-contained, clearance-volume adjustment means, according to claim 8, further including:

a flow restrictor interposed in one of said first and second conduits, intermediate the length thereof, for delimiting fluid flow therethrough.

13. A self-contained, clearance-volume adjustment means, for a gas compressor which has (a) a gas intake port, and (b) a head-end piston displaceable in adjacency to said port, comprising:

a source of hydraulic fluid;

a cylinder;

means for communicating said source with said cylinder for admitting fluid into, and for prohibiting fluid evacuation from, said cylinder;

wall means, confined within said cylinder, and movable therewithin, for subdividing said cylinder into a pair of chambers;

a rod connecting said wall means to said piston for effecting movement of said wall means in common with said piston; and valving means, cooperative with said communicating means, and coupled to said cylinder, operative in a (a) first mode for evacuating fluid from said cylinder, in response to a displacement of said piston in a first direction, and (b) second mode for admitting fluid into said cylinder, in response to a displacement of said piston in a second direction; wherein said piston has first and second, opposite faces;

one of said faces confronts said cylinder; and said gas intake port opens directly onto said one face.

* * * * *